United States Patent [19]

Andrees et al.

[11] Patent Number: 4,886,639

[45] Date of Patent: Dec. 12, 1989

[54] CONSTRUCTION ELEMENTS PRODUCED BY POWDER METALLURGY

[75] Inventors: Gerhard Andrees, Munich; Josef Kranzeder, Erding; Wilhelm Vogel, Aystetten, all of Fed. Rep. of Germany

[73] Assignee: MTU Motoren- und Turbinen-Union Muenchen GmbH, Munich, Fed. Rep. of Germany

[21] Appl. No.: 44,030

[22] PCT Filed: Jul. 29, 1986

[86] PCT No.: PCT/DE86/00306

§ 371 Date: Apr. 30, 1987

§ 102(e) Date: Apr. 30, 1987

[87] PCT Pub. No.: WO87/00781

PCT Pub. Date: Feb. 12, 1987

[30] Foreign Application Priority Data

Jul. 31, 1985 [DE] Fed. Rep. of Germany ..... 3527367

[51] Int. Cl.[4] ..... B22F 3/24

[52] U.S. Cl. ..... 419/28; 419/36; 419/38; 419/49; 419/54; 419/55; 419/57; 419/60

[58] Field of Search ..... 419/56–60, 419/38, 36, 28, 49, 54, 55

[56] References Cited

U.S. PATENT DOCUMENTS

| | | | |
|---|---|---|---|
| 3,432,296 | 3/1969 | McKinnon et al. | 25/214 |
| 4,002,473 | 1/1977 | Klein | 419/2 |

FOREIGN PATENT DOCUMENTS

| | | |
|---|---|---|
| 0065702 | 5/1982 | European Pat. Off. . |
| 3042052 | 5/1982 | Fed. Rep. of Germany . |
| 2007719 | 5/1979 | United Kingdom . |
| 2058039 | 4/1981 | United Kingdom . |

OTHER PUBLICATIONS

"Metals Handbook", Ninth Edition, vol. 7, Powder Metallurgy, American Society for Metals, Metals Park, Ohio, 44073, pp. 373, 374, 375 and 497.

*Primary Examiner*—Stephen J. Lechert, Jr.
*Attorney, Agent, or Firm*—W. G. Fasse; D. H. Kane, Jr.

[57] ABSTRACT

Structural component made of powder metallurgical materials, particularly temperature resistant alloys, nickel base alloys, are produced by injection molding or pressing. The sintering is divided into individual work steps for producing dense and smooth structural components which are true to shape.

24 Claims, 4 Drawing Sheets

FIG.1
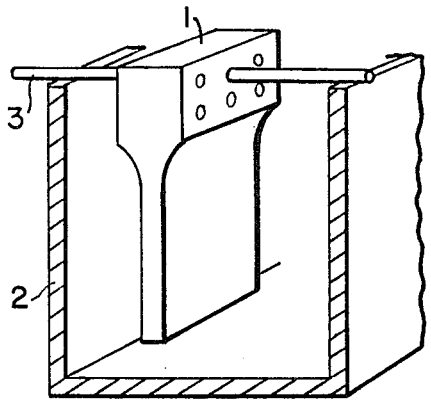
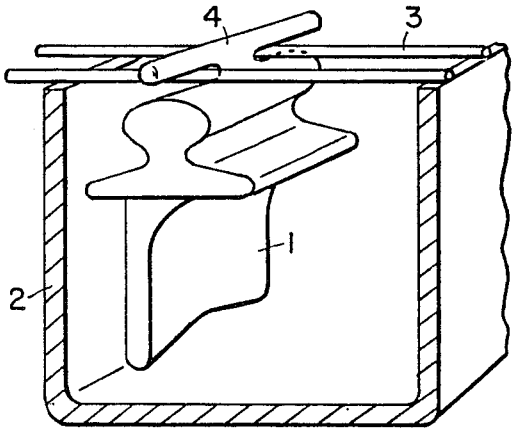
FIG. 2

CONSTRUCTION ELEMENTS PRODUCED BY POWDER METALLURGY

FIELD OF THE INVENTION

The invention relates to structural components produced by powder metallurgy, particularly by injection molding or injection pressing. In the production of structural components, especially high temperature resistant structural components which are shaped by injection molding or dry pressing and which are sintered or at least capable of being sintered, such components are placed, for example, on plates, or they are embedded in a powder or the like for the sintering following the shaping.

DESCRIPTION OF THE PRIOR ART

As a rule, the sintering takes place after the burn-out or evaporation of the binding agent or material which was mixed with the metallic alloy in the form of a starting powder. The structural components have only an extremely small shape retaining stability during the driving out of the binder agent. Thus, the components are very sensitive to any type of contact, and therefore must be supported or covered or otherwise protected by the support, or/base, or/intermediate layers or embedding material, whereby the sintering process is hindered. Besides, friction results at the contact locations whereby the friction forces oppose any shrinking forces. The danger of chemical reaction at the contact locations or contact surfaces is also not excludable at the high sintering temperatures reaching up to about 1300° C.

Further, due to the foregoing surface cracks, pores, or notches may occur or may increase in size. Due to nonuniform shrinking distortions may occur.

OBJECT OF THE INVENTION

It is the object of the invention to contribute to the production of such structural components which are temperature resistant and which have a contour or shape retaining stability, that is, they are true to size and have a smooth surface without cracks.

SUMMARY OF THE INVENTION

This objective has been achieved according to the invention by a method for producing of structural components having a complicated shape which have a high shape stability and dimensional accuracy as well as a high surface quality, and which are made of powder metallurgically processable materials by injection molding or pressing followed by a sintering, said method being characterized in that the prepared mass which contains powder metallurgically processable materials and a binding agent is deformed in an injection molding device or in a press such as a dry press, after heating out the binding agent in a mold. The preformed component or blank is introduced into a gas-tight, heatable container, especially of a vacuum oven or an oven with a protective gas atmosphere and sintered therein, whereby the preformed component or blank is freely exposed to the atmosphere in the oven, and whereby it is suspended or held freely floating so that at least the zones of its surface are exposed and accessible for a treatment, so that said surface zones are desirably free of cracks. According to the invention there is further provided, that said binding agent is added to the powder metallurgical materials for achieving a sufficient flowability, wherein the binding agent is first driven out after the shaping step by applying a burn-out temperature adapted to burn-out the binding agent. The structural components are then heated up to perform said first mentioned sintering step at a temperature between 50% and 70% of the solid status temperature of the powder metallurgical material in a vacuum or under a protective gas atmosphere for a duration of 0.1 to 10 hours, preferably 0.1 to 2 hours. A second sintering step is performed by again heating the blank in the same atmosphere to a temperature up to 400° C. higher than the temperature of the first sintering for a time duration sufficient for closing all cracks present in the outer surface.

BRIEF DESCRIPTION OF THE DRAWINGS

An example embodiment of the invention is illustrated purely schematically in the accompanying drawing.

FIG. 1 shows an injection molded metal sample in its treatment chamber, here a container of a sintering oven;

FIG. 2 shows an injection molded metal blade in its treatment chamber forming a container of a sintering oven, whereby the blade has a so-called dead head;

FIG. 7 shows a temperature-time characteristic for conventionally sintering of a powder charge sample in a single step resulting in a component as shown in FIG. 3*a.

Figure 3A:
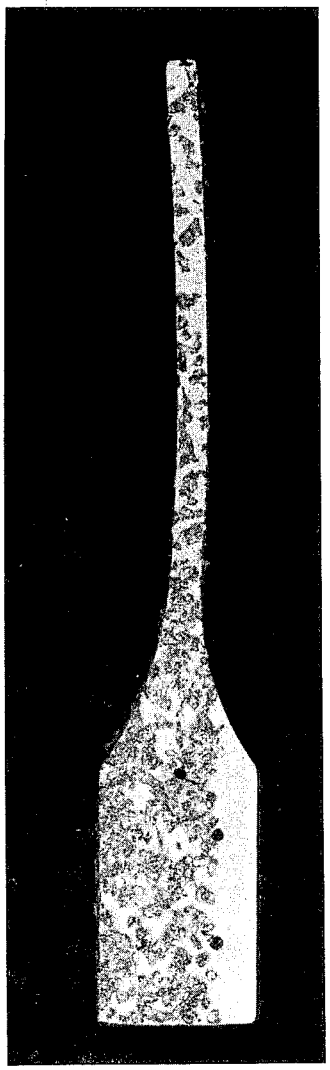
FIG. 3A PRIOR ART
FIG. 3*a* is a photograph of a conventionally sintered sample completely sintered in one step according to the temperature-time characteristic of FIG. 7.

DETAILED DESCRIPTION OF PREFERRED EXAMPLE EMBODIMENTS AND OF THE BEST MODE OF THE INVENTION

The powder metallurgical starting material, especially a globular powder of a nickel based alloy is mixed with a binding agent such as wax or thermoplastic material in a volume ratio of 40% to 80% of metal powder and 20% to 60% of binding agent. After an intimate mixing of the material, the resulting mass is brought into the desired shape of the structural component in an injection molding machine or in a dry press. After the heating out of the binding agent, the structural components are sintered without any compression. This sintering operation takes place in several stages, especially in two stages. The sintering may be followed by a secondary compression of the shaped body. Hot isostatic pressing is preferred for the secondary compression.

The structural components are so produced that following the steps known as such: shaping and burn-out, a first sintering step is performed at about 900° C. to 1100° C., where nickel base alloys are involved, or at 50% to 70% of the absolute solidus temperature, depending on the metal alloy used in a vacuum ($10^{-6}$ to $10^{-5}$ mbar) or in a protective gas with a heat-up speed of 150° C. to 600° C. per hour for preliminary sintering with a duration of 0.1 hours to 10 hours preferably 0.1 to 2.0 hours.

Subsequent to this heat treatment the structural components are not damaged by the supports or embedding materials and thus do not show any reaction on the surface. The structural components are now well suited for handling and the shrinking is small, between about 0% and 3%.

Thereafter the structural components 1 are secured to an oven frame 2 or some such container of metal or ceramic to be freely suspended, for example, on rods 3 passing through holes in the component 1 as shown in FIG. 1. The suspending rod or rods are best attached to a dead head 4 which is removable since this dead head 4 of the injection molded component 1 will not be needed later on anymore as shown in FIG. 2.

Thereafter, the second sintering takes place, that is, a heating of the structural component in a vacuum or in a protective gas to the necessary temperature which is within the range of about 1150° C. to 1300° C. depending on the metal alloy used. The heat-up speed must be so selected that any cracks that might still be present in the surface will close during the second heat treatment. For example, in connection with nickel base alloys, a heat-up between 20° and 100° K./min for up to about 2 hours and a maximum temperature of 60% to 98% of the solidus temperature of the alloy are selected.

Figure 3B:
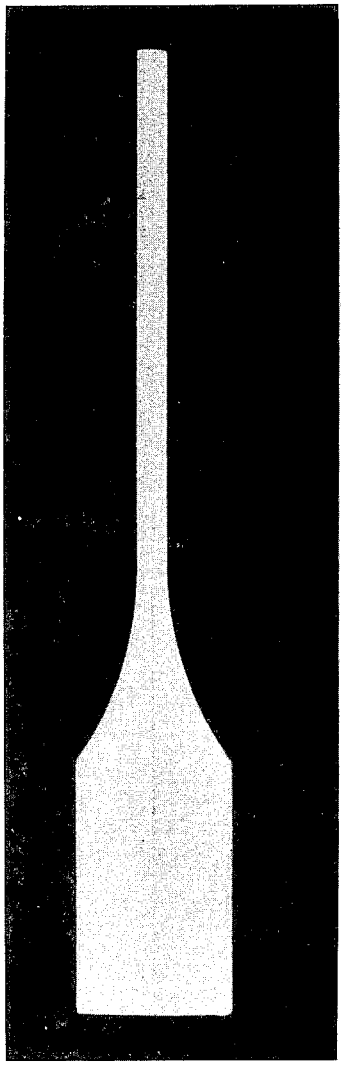
FIG. 3*b* is a sample sintered according to the method of the invention wherein the sample is completely sintered in two steps according to the temperature-time characteristic of FIG. 8.

The structural components produced in this manner do not have any contour flaws, please compare the bent shape resulting from a conventional sintering shown in FIGS. 3*a* with the straight shape achieved according to the invention and shown in FIG. 3*b*. As shown in FIG. 3*b* the sample has been linearly shrunk and thus it is hardly smaller, that is, they are practically true to dimension. The components can have almost any desired shape and it is a smooth dense surface free of cracks. The reached density of the structural component produced according to the invention was within the range of 95% to 98% of the theoretical density without secondary compression and the density was at 100% after a secondary compression using hot isostatic pressing.

Modifications of the above described and illustrated example embodiments may be made without thereby departing from the scope of the invention.

Figure 4:
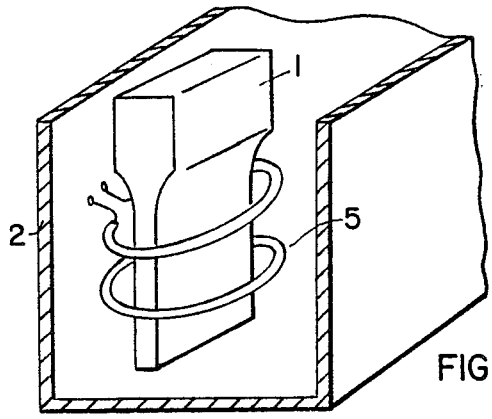
FIG. 4 shows a sample partially surrounded by a coil through which a current is flowing for suspending the sample in a magnetic field.
Figure 5:
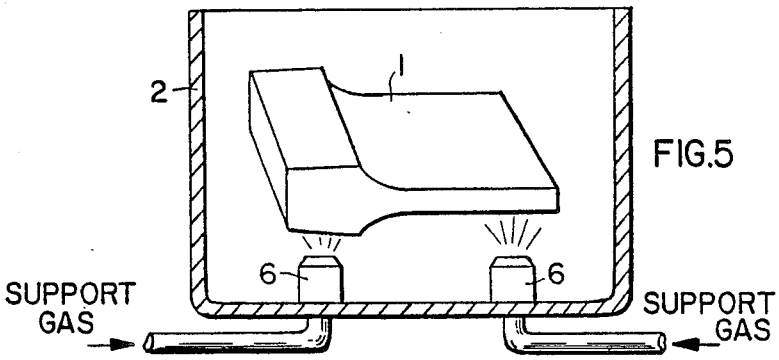
FIG. 5 shows a sample carried by an air cushion in a sintering position.
Figure 6:
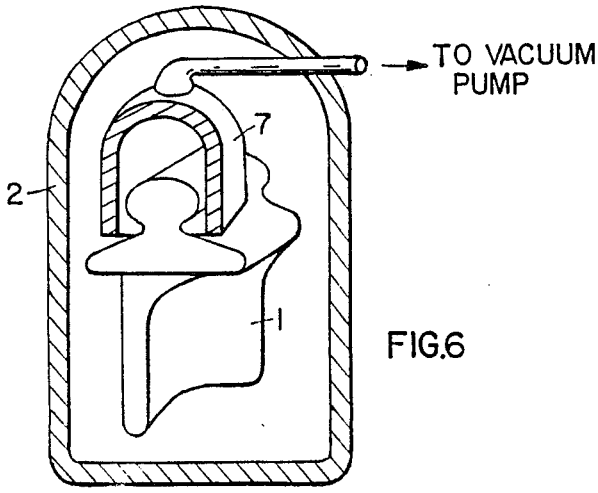
FIG. 6 shows a sample held by a suction bell in a sintering position.

Rather than holding the components to be sintered by means of the dead head 4, the samples may be kept suspended, for example, on a gas cushion formed by a multitude of nozzles 6 as shown in FIG. 5. A sample may instead be suspended in a magnetic field of the coil 5 as shown in FIG. 4. Another embodiment is shown in FIG. 6 using a suction bell 7 to maintain the component 1 in its position in a container 2. The container is made of a material such as $Al_2O_3$ or $ZrO_2$ which does not react with these components.

The geometric shape of the precision components to be produced is practically as desired. Depending on the desired final shape and dimensional accuracy, the injection molding method or the pressing method are selected with the respectively required injection mold or pressing mold having at least a near-net-shape. An example of such a device is described in German patent publication (DE-OS) No. 3,042,052.

Possibilities for processing the mass and for the injection molding are described in German patent publication (DE-OS) No. 3,120,501. The tight vacuum sintering and the heat treatment of powder metallurgically processed materials may be taken from "Metals Handbook", ninth Edition, Volume 7, pages 373–375.

However, the invention is neither limited to these materials, nor to this type of treatment. Particularly, other or additional treatments known as such may be employed, such as the secondary compression (HIP), hardening or heat treating, alloying or doping, coating (PVD, CVD) of a surface, for example, with a known diffusion coating.

The invention will be primarily used in connection with blades or rotors in the turbo engine construction.

Comparing of FIGS. 3*a* and 3*b* shows that according to the prior art the surface of the sample is contaminated and that the sample has been deformed please note the bend in the thin portion of the conventionally prepared sample. FIG. 3*b*, however, shows that the sample of the invention has a surface and geometry free of faults and it has a dimension and shape stability.

Thus, the invention achieves with simple means a very desirable result. The success of the combination of means according to the invention was not predictable at all and it provides the possibilities of further uses of structural components which are produced of powder type starting materials.

Figure 7:
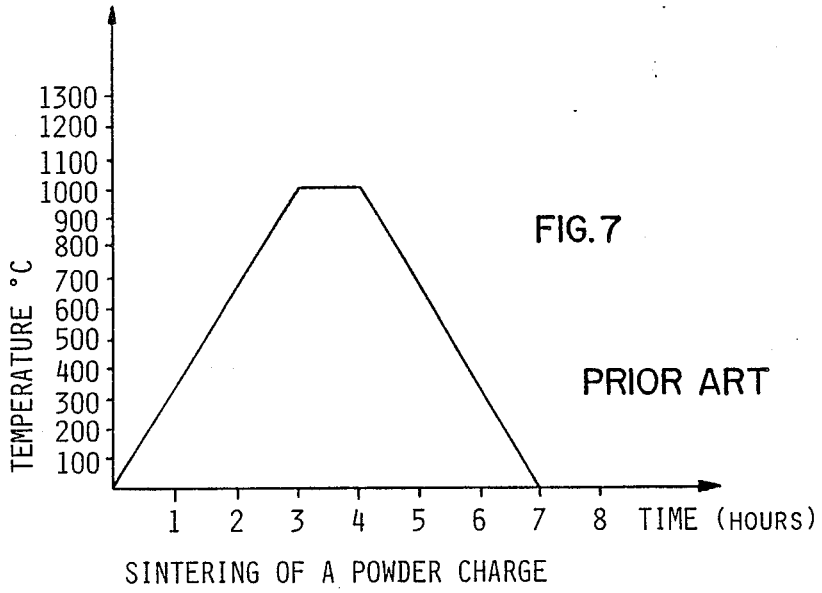
FIG. 7 PRIOR ART

In the following, the invention will be compared with the prior art to elucidate the advantages of the invention and the success achieved by the invention. In FIG. 7, the sintering of a powder charge according to the prior art is illustrated in a temperature time characteristic.

Figure 8:
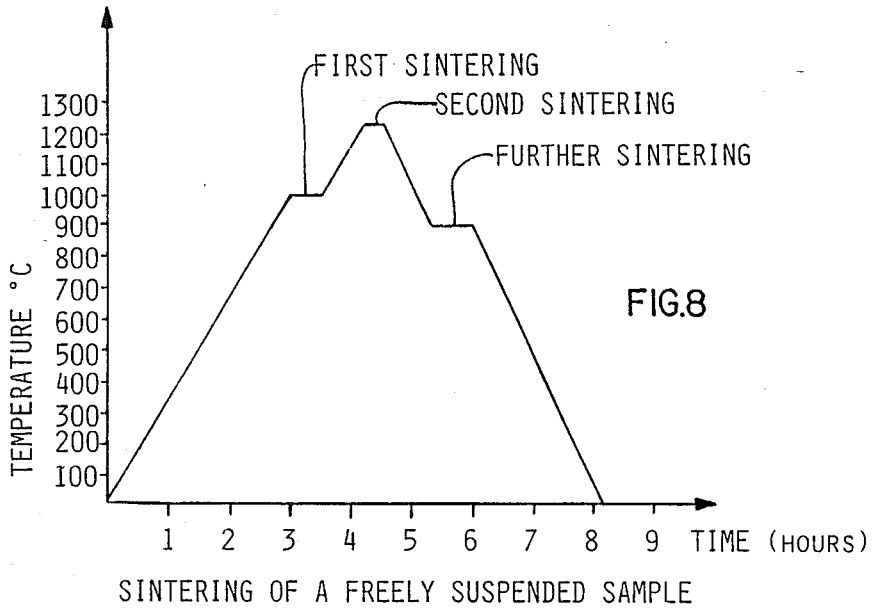
* and FIG. 8 shows the temperature-time characteristic for sintering of a freely accessible sample according to the method of the invention resulting in a component as shown in FIG. 3*b.*

FIG. 8 illustrates the sintering according to the invention with components freely suspended or freely floating in the treatment chamber, in accordance with a temperature time characteristic drawn to the same scale as in FIG. 7.

By comparing the two Figures, it is readily to be seen that in the prior art a temperture treatment, especially a high temperature treatment was performed in such a way that the temperature was increased evermore to a highest value and only toward the end of the treatment it was steadily decreased.

In the invention on the other hand, the temperature treatment is performed continuously in such a manner that after a second phase of increase including a renewed holding phase, at least one temperature decrease with a holding phase takes place. A third sintering may also be used as illustrated in FIG. 8.

It is considered to decisively contribute to the success of the invention that during the holding phases measures are taken as described above, particularly in an uninterrupted vacuum which is maintained in the treatment chamber throughout the entire duration until the end of the treatment.

The manipulation of the preshaped components or blanks is thereby controlled from the outside of the container 2.

Although the invention has been described with reference to specific example embodiments, it will be appreciated that it is intended to cover all modifications and equivalents within the scope of the appended claims.

We claim:

1. A method for producing a structural component having a complicated shape, a high dimensional accuracy and shape retaining stability and a high surface quality, made of powder metallurgically processable materials that may be molded and then sintered, comprising the following steps:

(a) mixing a powder of a metal alloy with a binder material to form a moldable mass, (b) molding said moldable mass into said complicated shape, (c) heating said complicated shape sufficiently to drive out said binder material to form a green blank, (d) introducing said green blank into a sintering oven and performing a first sintering in said sintering oven at a temperature corresponding to about 50 to 70% of the solidus temperature of said metal alloy powder for a duration of about six minutes to maximally ten hours whereby a resulting sintered blank substantially does not shrink during said first sintering yet has a sufficient strength for being handled, and so that the sintered blank is not exposed to any surface reaction during said first sintering, (e) freely suspending the sintered blank so that its surface zones are exposed and accessible for treatment in a second sintering, and (f) performing a second sintering at a temperature within the range of about 1150° C. to about 1300° C. and for a length of time sufficient to cause a linear shrinking of said structural component while avoiding cracks and achieving a density within the range of 95% to 98% of the theoretical density.

2. The method of claim 1, further comprising performing at least one further sintering step following said second sintering.

3. The method of claim 1, further comprising performing, subsequent to said second sintering, a follow-up densification in the form of a secondary compression to provide an actual density of said structural component corresponding to 100% of the theoretical density.

4. The method of claim 3, wherein said secondary compression is performed by a hot isostatic pressing operation.

5. The method of claim 1, wherein said powder of a metal alloy in said moldable mass comprises a globular nickel based alloy present in an amount of 20 to 60% by volume, and wherein said binder material is present in an amount of 40 to 80% by volume.

6. The method of claim 1, wherein said first sintering is performed at a temperature within the range of about 900° C. to about 1100° C.

7. The method of claim 1, wherein said first sintering is performed in a protective gas atmosphere with a heat-up speed of about 150° C. to about 600° C. per hour.

8. The method of claim 1, wherein said metal powder alloy is a nickel based alloy, and wherein said second sintering is performed with a heat-up speed of about 20 K.°/min. to about 100° K./min. and then continuing the second sintering at a maximal temperature within the range of about 60 to 98% of the solidus temperature of said metal powder alloy for about two hours.

9. The method of claim 1, wherein said step of freely suspending is performed by hanging said sintered blank in an oven frame for said second sintering.

10. The method of claim 9, wherein said oven frame is a metallic or ceramic oven container wherein the sintered blank is freely accessible for treatment in the second sintering step.

11. The method of claim 9, wherein said step of hanging is performed with the aid of rods.

12. The method of claim 11, further comprising providing said complicated shape in said molding step with a later detachable dead head, and mounting the green blank on said rods with said detachable dead head.

13. The method of claim 1, further comprising using a sintering oven container as a treatment chamber for said second sintering.

14. The method of claim 13, further comprising blowing a fluid medium into said treatment chamber for forming a fluid flow for holding said sintered blank in said treatment chamber in a sintering position.

15. The method of claim 14, further comprising forming said fluid flow with a protective or inert gas.

16. The method of claim 13, further comprising using a magnetic field for freely suspending said sintered blank in said sintering oven container forming said treatment chamber for said second sintering step.

17. The method of claim 1, wherein said step of freely suspending said sintered blank for said second sintering is performed by a suction bell which keeps said sintered blank freely levitated for treatment access from all sides with the aid of a vacuum pump.

18. The method of claim 1, wherein said binder material is selected from the group consisting of wax and thermoplastic materials.

19. The method of claim 1, wherein said molding step is performed by an injection molding operation.

20. The method of claim 1, wherein said molding step is performed by a compression molding operation.

21. The method of claim 1, wherein said step of introducing said green blank into said sintering oven comprises placing said green blank onto a neutral support capable of holding said green blank which does not yet have sufficient structural strength, said neutral support avoiding any reaction between said neutral support and said green blank, and moving said support into said sintering oven.

22. The method of claim 1, wherein said step of introducing said green blank into said sintering oven comprises embedding said green blank in a neutral embedding material in a container, and moving said container into said sintering oven, said neutral embedding material avoiding any reaction with said green blank.

23. The method of claim 1, wherein said first sintering is performed in a vacuum or in a protective gas atmosphere.

24. The method of claim 1, wherein said second sintering is performed in a vacuum or in a protective gas atmosphere.

* * * * *